US011952020B1

(12) United States Patent
Beatrice et al.

(10) Patent No.: US 11,952,020 B1
(45) Date of Patent: Apr. 9, 2024

(54) SYSTEM AND METHOD FOR CONTROLLING RIDE VEHICLE RESTRAINT VIA COMPUTER IMPLEMENTED PROCESS

(71) Applicant: UNIVERSAL CITY STUDIOS LLC, Universal City, CA (US)

(72) Inventors: Michael Anthony Beatrice, Orlando, FL (US); Gregory Paul Habiak, Orlando, FL (US); David Gerard Majdali, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 0 days.

(21) Appl. No.: 18/345,979

(22) Filed: Jun. 30, 2023

(51) Int. Cl.
*B61K 13/04* (2006.01)

(52) U.S. Cl.
CPC ..... *B61K 13/04* (2013.01)

(58) Field of Classification Search
CPC ..... B61K 13/04
See application file for complete search history.

(56) References Cited

U.S. PATENT DOCUMENTS 5,590,603 A * 1/1997 Lund ..... E01B 25/08 246/29 R
6,916,057 B2 * 7/2005 Teich ..... B60N 2/3045 297/331
8,632,131 B2 * 1/2014 Humbert ..... B60R 22/46 297/484
9,266,487 B2 * 2/2016 Engelman ..... G06V 20/593
9,839,855 B2 * 12/2017 Stenzler ..... G06V 10/245
11,345,309 B2 * 5/2022 Bruno ..... B60R 22/48
2004/0164598 A1 * 8/2004 Teich ..... B60N 2/3045 297/335
2017/0189818 A1 * 7/2017 Stenzler ..... G06V 10/245
2021/0354646 A1 * 11/2021 Wilcox ..... B60R 21/02
2021/0380064 A1 * 12/2021 Akoma ..... B60R 21/0132

* cited by examiner

*Primary Examiner* — Phutthiwat Wongwian
*Assistant Examiner* — Susan E Scharpf
(74) *Attorney, Agent, or Firm* — LOZA & LOZA, LLP; Lew Edard V. Macapagal

(57) ABSTRACT

Aspects of the disclosure relate to methods, apparatus, and systems for controlling a ride vehicle restraint in a ride system. A system is configured to identify one or more ride vehicles stopped at a passenger loading platform, the one or more ride vehicles including one or more seats, determine which seat or seats of the one or more seats are in-service or out-of-service based at least in part on data corresponding to the identity of the one or more ride vehicles, instruct to lock one or more restraint systems corresponding to at least one seat of the one or more seats determined to be out-of-service, and instruct to unlock one or more other restraint systems corresponding to at least one seat other seats of the one or more seats determined to be in-service.

20 Claims, 7 Drawing Sheets

SYSTEM AND METHOD FOR CONTROLLING RIDE VEHICLE RESTRAINT VIA COMPUTER IMPLEMENTED PROCESS

TECHNICAL FIELD

The technology discussed below relates generally to ride vehicle restraint systems, and more particularly, to inhibiting movement of a ride vehicle restraint.

INTRODUCTION

Restraint systems are used to safely restrain passengers in amusement park ride vehicles. For example, a restraint system is provided to contain a seated, standing, or prone passenger. With seated rides, a restraint system may take the form of a crossbar (e.g., lap bar, T-bar, etc.) placed against the torso or thighs of the passenger. In an example, the crossbar may be supported by one or more support bars rotatably coupled to a pivot mounted at or near a ride vehicle floor in close proximity to the passenger's legs. As such, the crossbar may move toward or away from the passenger as the one or more support bars are caused to rotate about the pivot toward or away from the passenger. However, problems may arise when individual seats on a ride vehicle are out-of-service but the ride vehicle overall is still in-service to passengers.

For example, when one or more seats of a ride vehicle is out-of-service but the rest of the seat rows are otherwise in-service to the passengers, a ride operator and/or technician (e.g., ride technician) may implement a procedure to prevent passengers from sitting in an out-of-service seat. The procedure may include the ride operator and/or technician locking (e.g., strapping down) in a closed position a restraint system of the out-of-service seat and/or placing a physical barrier on the restraint system to prevent the restraint system from opening, and therefore, prevent a passenger from sitting in the out-of-service seat. The procedure may include the ride operator and/or technician monitoring the passengers as they board the ride vehicle and preventing a passenger from entering the and/or sitting in the out-of-service seat. However, a ride operator and/or technician may not notice a passenger unlock the restraint system from the closed position and/or remove the physical barrier on the restraint system, and the passenger may sit in the out-of-service seat.

Accordingly, what is needed is a system and method that monitors when one or more seats of a ride vehicle is out-of-service and prevents a restraint system of the one or more out-of-service seats from being opened. The present disclosure is directed to controlling a restraint system of an out-of-service seat to lock or remain locked.

BRIEF SUMMARY OF SOME EXAMPLES

The following presents a summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Aspects of the disclosure relate to methods, apparatus, and systems for controlling a ride vehicle restraint in a ride system. A ride system may include one or more ride vehicles including one or more seats, a passenger loading platform, a ride vehicle identifier configured to identify the one or more ride vehicles stopped at the passenger loading platform, and a controller communicatively coupled to the one or more seats and/or the ride vehicle identifier. The controller may be configured to determine which seat or seats of the one or more seats are in-service or out-of-service based at least in part on data corresponding to an identity of the one or more ride vehicles. If any of the seats of the one or more seats are determined to be out-of-service, the controller may be configured to instruct to lock one or more restraint systems corresponding to at least one seat of the one or more seats determined to be out-of-service. If any of the seats of the one or more seats are determined to be in-service, the controller may be configured to instruct to unlock one or more other restraint systems corresponding to at least one other seat of the one or more seats determined to be in-service. The ride system may include an interface device communicatively coupled to the controller, wherein the controller is configured to receive the data via the interface device, and wherein the interface device is configured to receive the data from a ride system operator (e.g., ride operator) and/or technician (e.g., ride system technician, ride technician). The data corresponding to the identity of the one or more ride vehicles may be received prior to the one or more ride vehicles stopping at the passenger loading platform. The data corresponding to the identity of the one or more ride vehicles may indicate if one or more seats are in-service and/or if one or more seats are out-of-service and/or which seat(s) of the one or more seats is in-service and/or which seat(s) of the one or more seats are out-of-service. The controller may be configured to receive the data corresponding to the identity of the one or more ride vehicles via the interface device. Other aspects, embodiments, and features are also claimed and described.

In one example, a method of controlling a ride vehicle restraint in a ride system is disclosed. The method includes identifying one or more ride vehicles stopped at a passenger loading platform, the one or more ride vehicles including one or more seats, determining which, if any, seat or seats of the one or more seats are in-service or out-of-service based at least in part on data corresponding to an identity of the one or more ride vehicles, instructing, if any seats of the one or more seats are determined to be out-of-service, at least one seat of the one or more seats to lock one or more restraint systems corresponding to at least one seat of the one or more seats determined to be out-of-service, and instructing, if any seats of the one or more seats are determined to be in-service, to unlock one or more other restraint systems corresponding to at least one other seat of the one or more seats determined to be in-service. The method further includes receiving data corresponding to the identity of the one or more ride vehicles prior to the one or more ride vehicles stopping at the passenger loading platform, wherein the data corresponding to an identity of the one or more ride vehicles indicates which seat or seats of the one or more seats, if any, are in-service and/or which seat or seats of the one or more seats, if any, are out-of-service.

In one example, a controller for instructing a ride vehicle restraint in a ride system is disclosed. The controller may comprise at least one processor. The at least one processor may be configured to identify one or more ride vehicles stopped at a passenger loading platform, the one or more ride vehicles including one or more seats. The at least one processor may be configured to determine which seat or seats of the one or more seats are in-service, if any. The at least one processor may be configured to determine which seat or seats of the one or more seats, if any, are out-of-service, if any. The at least one processor may be configured to make the determination which seat or seats of the one or more seats are in-service, if any, and/or the processor may be configured to make the determination which seat or seats of the one or more seats are out-of-service, if any, based at least in part on data corresponding to an identity of the one or more ride vehicles. The processor may be configured to instruct to lock one or more restraint systems corresponding to at least one seat of the one or more seats determined to be out-of-service, and/or the processor may be configured to instruct to unlock one or more other restraint systems corresponding to at least one other seat of the one or more seats determined to be in-service. The at least one processor may be configured to receive data corresponding to the identity of the one or more ride vehicles prior to the one or more ride vehicles stopping at the passenger loading platform. The data corresponding to the identity of the one or more ride vehicles may indicate which seat or seats of the one or more seats are in-service, and/or the data corresponding to the identity of the one or more ride vehicles may indicate which seat or seats of the one or more seats are out-of-service.

DETAILED DESCRIPTION

Figure 1:
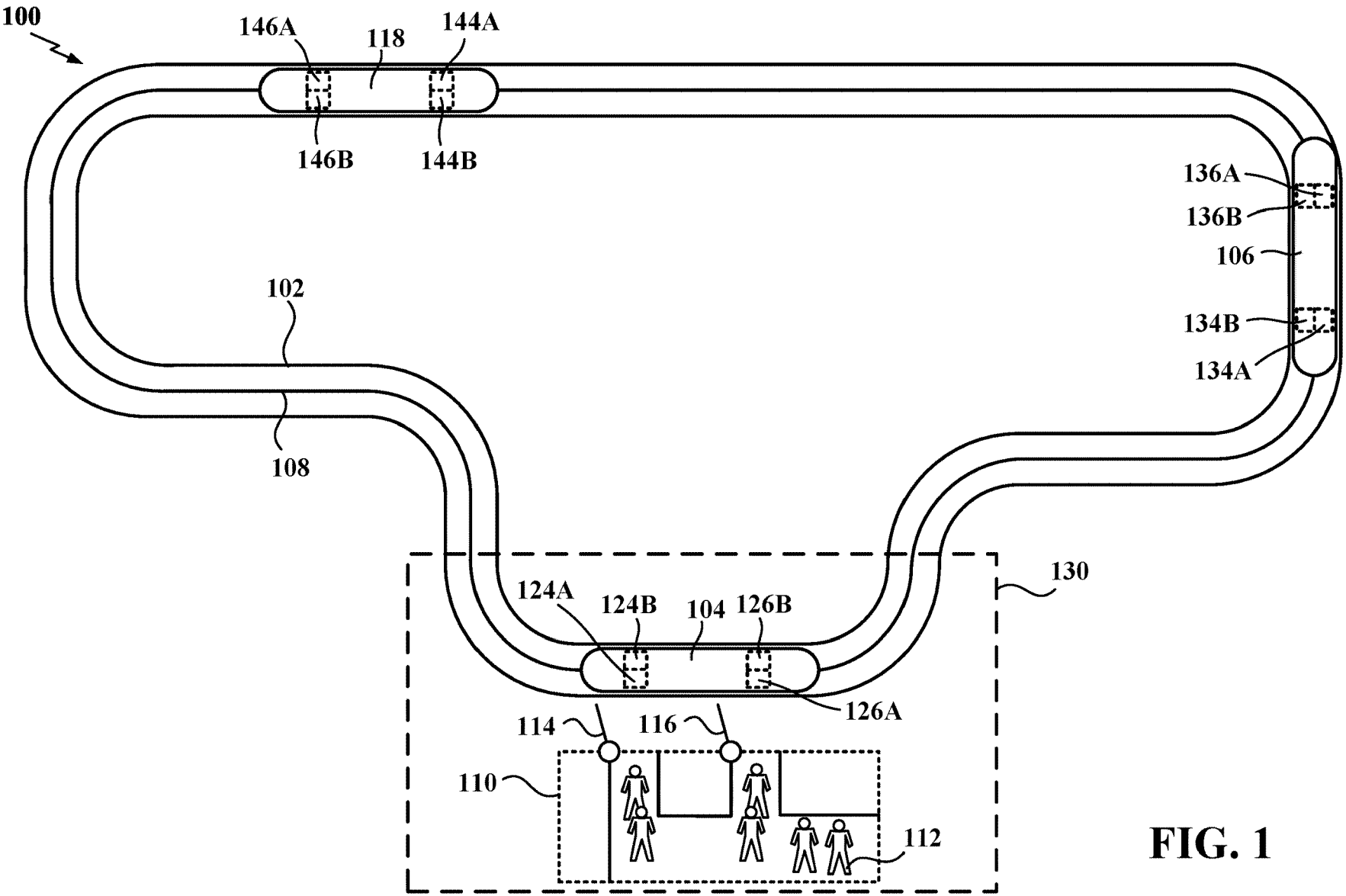
FIG. 1 is a top view of an example ride system in accordance with various aspects of the disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts. While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, and/or packaging arrangements.

The present disclosure is directed to a system and method of controlling a restraint system of a ride vehicle seat. In an aspect, a controller may monitor one or more seats of a ride vehicle for data indicating that one or more seats of the ride vehicle are out-of-service and/or the controller may determine that and/or when one or more seats of the ride vehicle is out-of-service. The controller may prevent the restraint system of the one or more out-of-service seats from being opened when the ride vehicle arrives at a passenger loading platform, thus inhibiting a passenger from sitting in the one or more out-of-service seats determined to be out-of-service.

The controller of the present disclosure may instruct restraint corresponding to the out-of-service seat to not open, thus inhibiting a passenger from sitting in the out-of-service seat. It may be desirable to place a seat out-of-service for at least one of a variety of reasons. For example, it may be desirable to keep a seat empty to control a weight distribution on a ride vehicle (e.g., partially loading a ride vehicle). Changing a weight distribution of a ride vehicle may allow for changed or reduced wear (e.g., reduced wear in certain portions of a ride vehicle, reduced wear throughout the entire ride vehicle, reduced wear on the infrastructure (e.g., ride path (e.g. track, flume), brakes, acceleration systems) or allow for modifying a passenger experience while riding a ride vehicle (e.g., placing more weight in certain areas of a ride vehicle may minimize or maximize the chance passengers may get splashed and/or wet on a ride, changing weight placement throughout a rollercoaster train may alter momentum throughout the ride experience, changing weight distribution may alter what parts of a ride path a passenger may experience, or which ride path of a plurality of ride paths passenger may experience). Further, if it is determined that completely filling a ride vehicle would exceed a desired total weight (e.g., weight limit) of a loaded vehicle, it may be desirable to put a seat out-of-service to prevent passengers from boarding a seat of the ride vehicle. It may also be desirable to place a seat out-of-service if the seat requires maintenance. This may allow passenger throughput of a ride to continue (e.g., at a reduced rate) until at least a threshold number of seats of a ride vehicle requires maintenance (e.g., and the entire ride vehicle is removed from service (e.g., pulled from service) during operating hours) or until after operating hours and no passenger throughput is desired. Additionally, it may be desirable to place a seat out of service if an out-of-service triggering event is detected by a sensor system. An out of service triggering event may comprise an event that may require inspection and/or maintenance (e.g., a threshold number of cycles completed) of a ride vehicle seat, a seat row of a ride vehicle, and/or even an entire ride vehicle. An out-of-service triggering event may also comprise a detected malfunction, detected damage, detected possible damage, and/or detected possible malfunction. After an out-of-service triggering event is detected, an inspection may be performed to confirm if any maintenance (e.g., repair, replacement) of any components (e.g., restraints, special effects, speakers, lights) of the seat, seat row, and/or ride vehicle may be necessary. Additionally, it may be desirable to place one or more seats, one or more seat rows, and/or one or more ride vehicles out-of-service to allow for certification runs for a seat and/or seat row of one or more ride vehicles and/or one or more ride vehicles of a system of ride vehicles that all board at the same time at the same platform. Further, it may be desirable to keep a seat out-of-service if testing equipment is installed in or on the seat. It may also be desirable to place a seat out-of-service if the seat is an accommodation seat that is not actively being used and/or needed. An accommodation seat may be a seat designed to accommodate passengers of certain sizes (e.g., certain heights (e.g., relatively taller or shorter), certain widths (e.g., relatively greater widths, relatively lesser widths) or weights (e.g., relatively greater weights, relatively lesser weights)). An accommodation seat may also be a seat designed for passengers that may have additional needs or require additional assistance (e.g., wheelchair accommodations (e.g., allowing a wheelchair to couple with a seat and/or ride vehicle, transferring passengers from a wheelchair onto an accommodation seat of a ride vehicle)). For the above reasons and/or similar reasons, it may be desirable to make a seat out-of-service.

FIG. 1 is a top view of an example ride system 100 in accordance with various aspects of the disclosure. The ride system 100 may include a path 102 and one or more ride vehicles configured to move along the path 102. As shown in FIG. 1, a first ride vehicle 104 is stopped on the path 102 near a passenger loading platform 110. Other ride vehicles, such as a second ride vehicle 106 and a third ride vehicle 118, may simultaneously travel along the path 102 while the first ride vehicle 104 is stopped. In some aspects of the disclosure, the path 102 may include one or more tracks or guide rails, such as the center guide rail 108 shown in FIG. 1, for guiding and/or moving a ride vehicle along the path 102.

The passenger loading platform 110 provides an area for ride passengers 112 to queue before boarding one of the ride vehicles. In an aspect, the ride system 100 may include a gate system (e.g., shotgun gate system) configured to control the flow of ride passengers 112 boarding the ride vehicles. The gate system may include one or more gates respectively corresponding to one or more rows of seats available on a ride vehicle. As shown in FIG. 1, a first gate 114 is configured to control a flow of ride passengers intending to board a first seat row of the first ride vehicle 104 and a second gate 116 is configured to control a flow of ride passengers intending to board a second seat row of the first ride vehicle 104. In an aspect, the gate system may be configured to actuate all gates to open and/or close, such as when the ride vehicle is stopped near the platform 110. In the example shown in FIG. 1, the first gate 114 and the second gate 116 are opened to allow the passengers 112 to enter the seat rows of the first ride vehicle 104.

In an aspect, each seat row of a ride vehicle may include one or more ride vehicle seats. For example, the first seat row of the first ride vehicle 104 may include a first seat 124A and a second seat 124B. The second seat row of the first ride vehicle 104 may include a third seat 126A and a fourth seat 126B. In another example, a first seat row of the second ride vehicle 106 may include a first seat 134A and a second seat 134B and a second seat row of the second ride vehicle 106 may include a third seat 136A and a fourth seat 136B. In a further example, a first seat row of the third ride vehicle 118 may include a first seat 144A and a second seat 144B and a second seat row of third ride vehicle 118 may include a third seat 146A and a fourth seat 146B.

Figure 2:
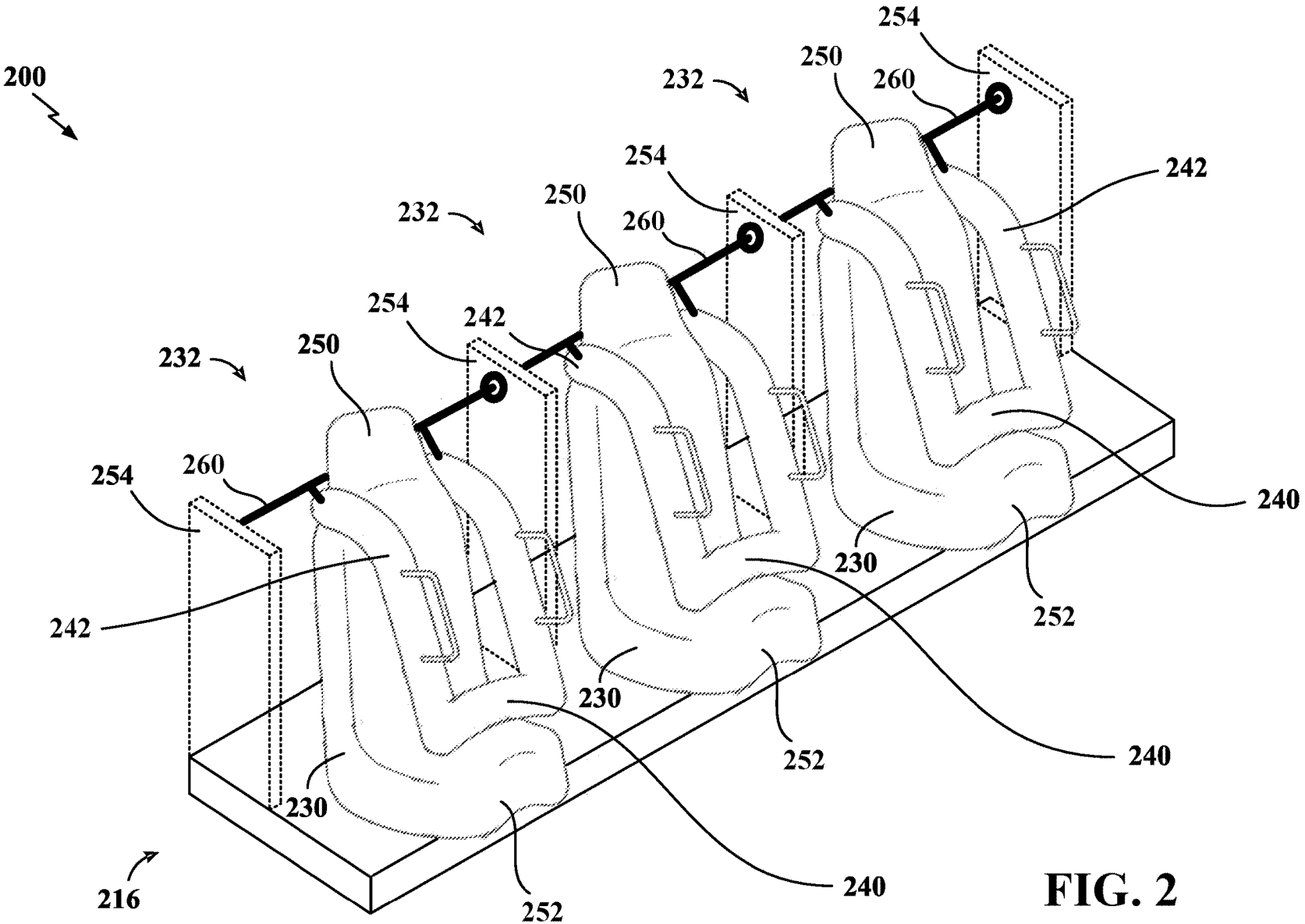
FIG. 2 is a diagram showing a front perspective view of an example seat row of a ride vehicle in accordance with various aspects of the disclosure.

FIG. 2 is a diagram 200 showing a front perspective view of an example seat row 216 of a ride vehicle in accordance with various aspects of the disclosure. The seat row shown in FIG. 2 is provided with three seats 230 as an example but is not intended to be limiting as the seat row may support more or less seats (e.g., one seat per row, two seats per row as shown in FIG. 1, four seats per row).

In an aspect, each seat 230 may include a seat back 250, a seat pan 252, and one or more side structures 254. The one or more side structures may be formed alongside the seat back 250 and/or the seat pan 252. Moreover, each seat 230 is provided with a restraint system 232 configured to restrain a passenger (e.g., guest) within the seat 230 (e.g., against the seat back 250 and/or the seat pan 252) when the ride vehicle moves. The restraint system 232 may include a crossbar 240 (e.g., lap bar, T-bar, etc.) to be placed against the torso and/or thighs of the passenger. In an aspect, the crossbar 240 may be made of a rigid material, a soft material (e.g. foam pad), or a combination thereof. The restraint system 232 may further include one or more support bars 242 (e.g., restraint tubes). One or more crossbars 240 may be coupled with or fixed to one or more support bars 242 (e.g., one or more respective support bars). In particular, a support bar 242 may have a first support bar end coupled to the crossbar 240 and a second support bar end rotatably coupled to a pivot 260. The pivot 260 may be mounted to an upper-rear portion of the seat 230 behind the seat back 250. The coupling between the second support bar end and the pivot 260 may comprise a translating relationship. For example, the coupling may facilitate the one or more support bars 242 to move forward, backward, up, and/or down.

Figure 3:
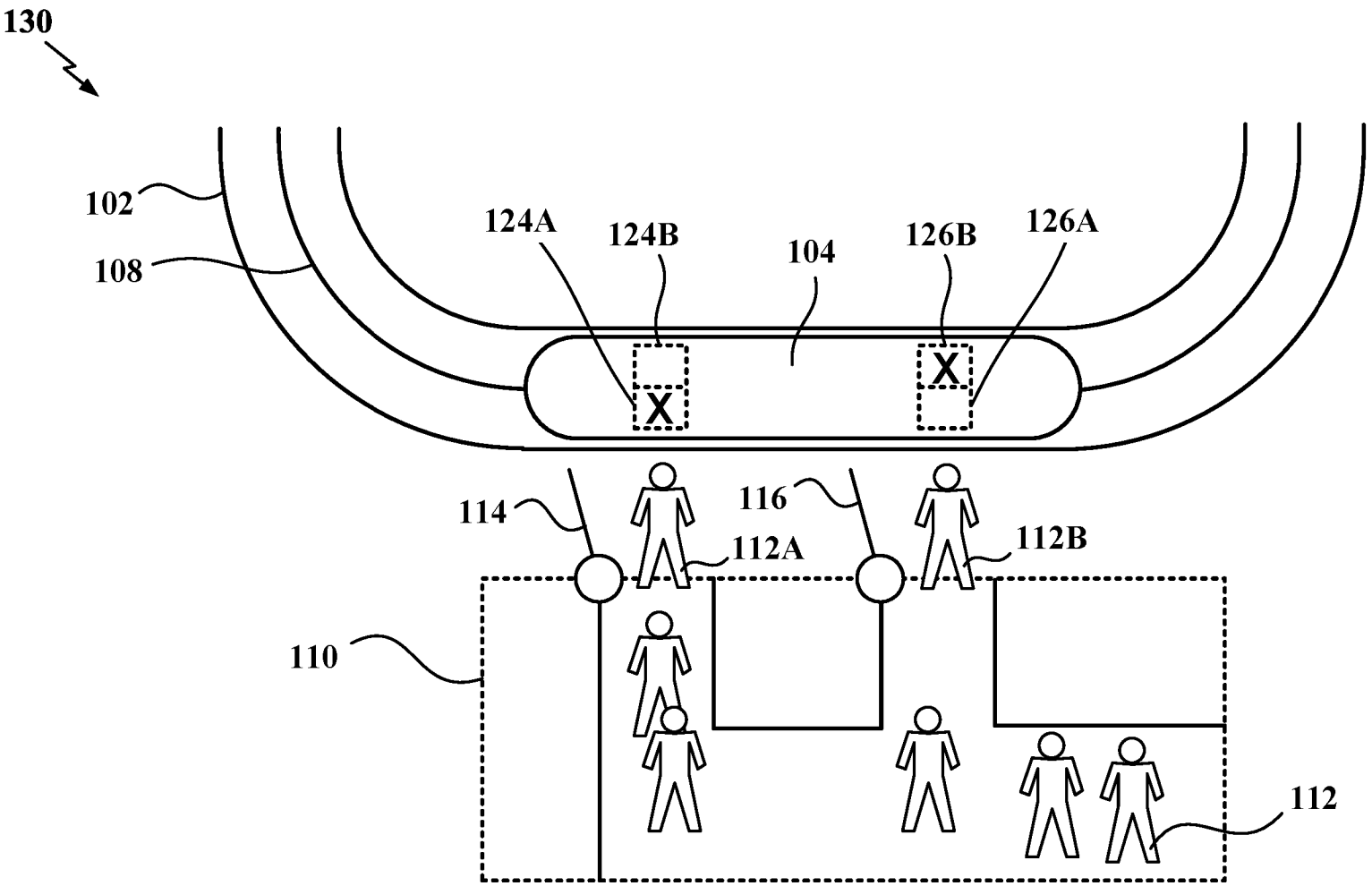
FIG. 3 is an expanded view of a region of the example ride system depicted in FIG. 1 in accordance with various aspects of the disclosure.

FIG. 3 is an expanded view of a region 130 of the example ride system 100 depicted in FIG. 1 in accordance with various aspects of the disclosure. In an aspect, one or more seats of a seat row of a ride vehicle may be out-of-service for one reason or various reasons. Accordingly, a ride operator or technician may implement a procedure to prevent passengers from sitting in an out-of-service seat of an out-of-service row.

As shown in FIG. 3, one or more seats of the first seat row (e.g., first seat 124A) of the first ride vehicle 104 and one or more seats of the second seat row (e.g., fourth seat 126B) of the first ride vehicle 104 are out-of-service. As part of the procedure, the ride operator and/or technician may lock (e.g., strap down) a restraint system of the first seat 124A and/or the fourth seat 126B in a closed position to prevent the restraint system from opening, and therefore, prevent a passenger from sitting in the out-of-service seat. Additionally or alternatively, the ride operator and/or technician may place a physical barrier on the restraint system and/or the out-of-service seat to prevent a passenger from sitting in the out-of-service seat. For example, the ride operator and/or technician may bag or block the out-of-service seat to prevent the passenger from sitting. The procedure may further include the ride operator and/or technician monitoring passengers as they board ride vehicles and preventing a passenger from sitting in the out-of-service seat (e.g., first seat 124A or fourth seat 126B).

In an aspect, while one or more seats of a seat row of a ride vehicle may be out-of-service, other seats in the seat row may be in-service to the passengers. That is, the other seats in the seat row may be available to be boarded by the passengers. As shown in FIG. 3, one or more seats of the first seat row (e.g., second seat 124B) of the first ride vehicle 104 and one or more seats of the second seat row (e.g., third seat 126A) of the first ride vehicle 104 are in-service. Accordingly, when the first ride vehicle 104 is stopped on the path 102 near the passenger loading platform 110, the gate system may control (e.g., instruct) the first gate 114 to open to allow a first passenger 112A to enter the first seat row having one or more in-service seats (e.g., in-service second seat 124B). The gate system may control (e.g., instruct) the second gate 116 to open to allow a second passenger 112B to enter the second seat row having one or more in-service seats (e.g., in-service third seat 126A). However, a passenger (e.g., first passenger 112A or second passenger 112B) entering a seat row to sit in an in-service seat may attempt to sit in an out-of-service seat (e.g., first seat 124A or fourth seat 126B).

Aspects of the present disclosure relate to a ride system configured to monitor when one or more seats of a ride vehicle is out-of-service and prevent a restraint system of the one or more out-of-service seats from being opened. Referring to FIG. 3 as an example, in the first row of the first ride vehicle 104, the first seat 124A is out-of-service and the second seat 124B is in-service. In the second row of the first ride vehicle 104, the third seat 126A is in-service and the fourth seat 126B is out-of-service. In an aspect, when the first ride vehicle 104 is stopped on the path 102 near the passenger loading platform 110, the ride system may control (e.g., instruct) the restraint system of the first seat 124A in the first row to lock or remain locked while controlling the restraint system of the second seat 124B in the first row to open and/or unlock. This prevents the first passenger 112A passing through the first gate 114 from sitting in the out-of-service first seat 124A and prompts the first passenger 112A to sit in the in-service second seat 124B. Similarly, when the first ride vehicle 104 is stopped on the path 102 near the passenger loading platform 110, the ride system may control (e.g., instruct) the restraint system of the third seat 126A in the second row to open and/or unlock while controlling the restraint system of the fourth seat 126B in the second row to lock or remain locked. This prevents the second passenger 112B passing through the second gate 116 from sitting in the out-of-service fourth seat 126B and prompts the second passenger 112B to sit in the in-service third seat 126A. Accordingly, if the ride operator and/or technician is unaware of an out-of-service seat on the first ride vehicle 104 or is not in a position to deter the first passenger 112A or the second passenger 112B from sitting in the out-of-service seat, the ride system may lock or keep locked the restraint systems of the out-of-service seats to prevent the passengers from manually opening the restraint systems and/or sitting in the out-of-service seats.

Figure 4:
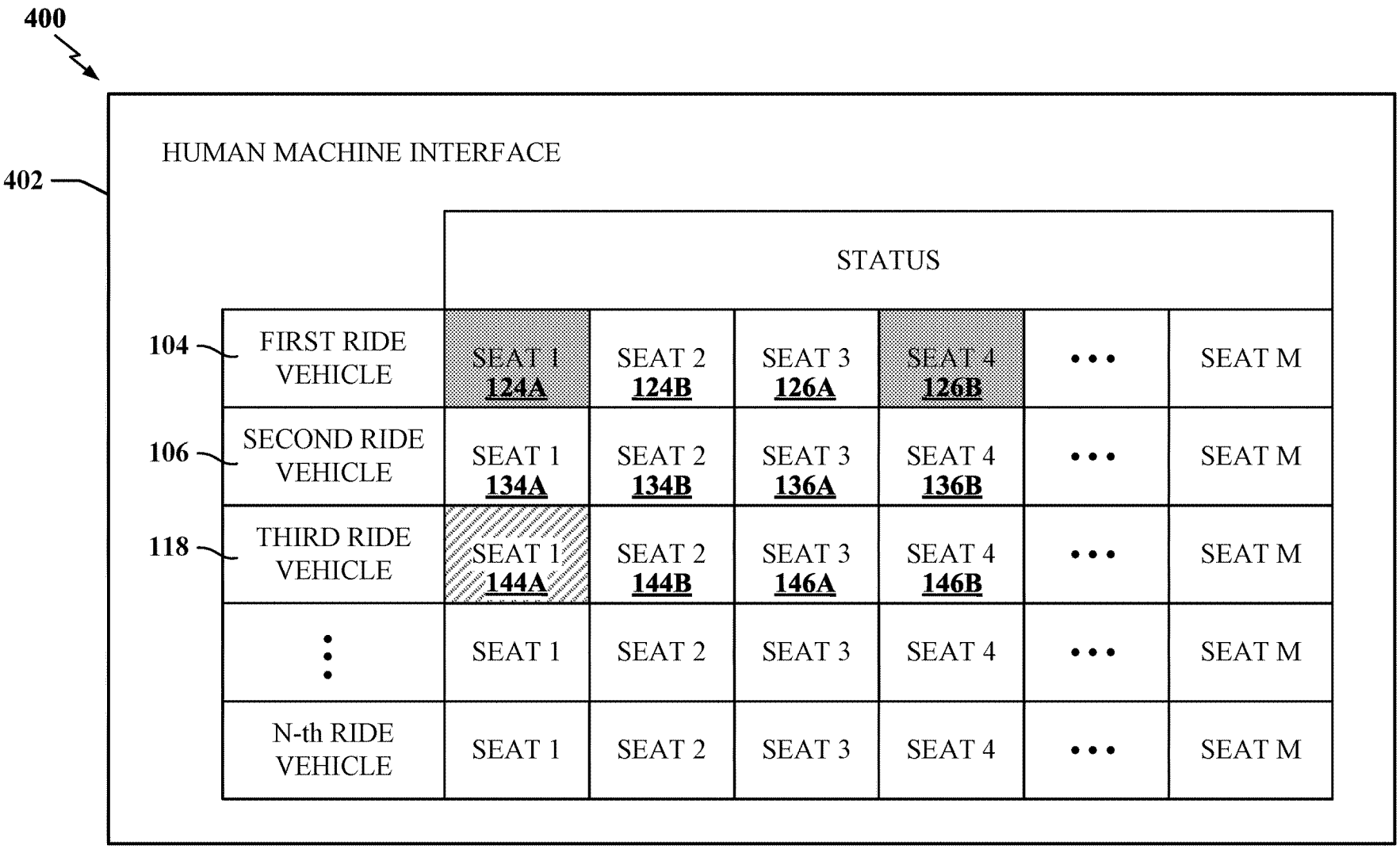
FIG. 4 illustrates an example of a human machine interface (HMI) for receiving and displaying ride vehicle data in accordance with various aspects of the disclosure.

FIG. 4 illustrates an example of a human machine interface (HMI) 400 for receiving and displaying ride vehicle data in accordance with various aspects of the disclosure. The HMI 400 may include a display (e.g., screen) 402 configured to display status data of ride vehicles operating in the ride system. As shown in FIG. 4, the HMI 400 may display data related to a first ride vehicle up to an N-th ride vehicle, where N is an integer greater than 1 (N>1). A maximum value of N may depend on a maximum capacity of ride vehicles capable of being operated in the ride system. In the example of FIG. 4, the data displayed on the HMI 400 includes data for the first ride vehicle 104, the second ride vehicle 106, and the third ride vehicle 118 shown in FIG. 1. In an aspect, the ride vehicles may be displayed and/or listed on the HMI 400 according to a unique identifying attribute (e.g., radio frequency identification (RFID) tag, bar code, quick response (QR) code, image, retroreflective pattern, light pulse pattern, color, and/or ride vehicle count) assigned to each ride vehicle.

In an aspect, the HMI 400 displays status data of each seat of a ride vehicle. For example, the status data may include an indication of whether a seat of a ride vehicle is in-service or out-of-service. As shown in FIG. 4, the HMI 400 may display status data of a first seat up to an M-th seat of a ride vehicle, where M is an integer greater than 1 (M>1). A maximum value of M may depend on a maximum number of seats present in the ride vehicle. In the example of FIG. 4, the status data displayed on the HMI 400 includes status data for the first seat 124A, the second seat 124B, the third seat 126A, and the fourth seat 126B of the first ride vehicle 104, status data for the first seat 134A, the second seat 134B, the third seat 136A, and the fourth seat 136B of the second ride vehicle 106, and status data for the first seat 144A, the second seat 144B, the third seat 146A, and the fourth seat 146B of the third ride vehicle 118.

In an aspect, a status of a seat may be indicated on the HMI 400 via color. In particular, a field corresponding to a seat of a ride vehicle may be shown in different colors on the HMI 400 based on whether the seat is in-service or out-of-service. For example, regarding the first ride vehicle 104, the first seat 124A may be out-of-service, the second seat 124B may be in-service, the third seat 126A may be in-service, and the fourth seat 126B may be out-of-service. Accordingly, as shown in FIG. 4, the HMI 400 may display a field corresponding to the second seat 124B and a field corresponding to the third seat 126A in a clear or white color to indicate that the seats are in-service and display a field corresponding to the first seat 124A and a field corresponding to the fourth seat 126B in a gray color to indicate that the seats are out-of-service. Regarding the second ride vehicle 106, the first seat 134A, the second seat 134B, the third seat 136A, and the fourth seat 136B may all be in-service. Therefore, the HMI 400 may display a fields corresponding to the first seat 134A, the second seat 134B, the third seat 136A, and the fourth seat 136B in a clear or white color to indicate that the first seat 134A, the second seat 134B, the third seat 136A, and the fourth seat 136B are in-service. In an aspect, the colors depicting a status of a seat (e.g., whether a seat is in-service or out-of-service) may not be limited to the colors clear/white and gray. It is contemplated that any color, or combination of colors, may be used to depict the status of the seat. For example, the colors green and/or blue may be used to depict that the seat is in-service and the colors yellow and/or red may be used to depict that the seat is out-of-service.

In an aspect, a status of a seat may be indicated on the HMI 400 by a visual mark. In particular, a field corresponding to a seat of a ride vehicle may be shown to have a distinguishing mark on the HMI 400 (e.g., check mark, pattern design, or any other mark suitable for distinguishing the field) based on whether the seat is in-service or out-of-service. For example, regarding the third ride vehicle 118, the first seat 144A may be out-of-service while the second seat 144B, the third seat 146A, and the fourth seat 146B may be in-service. Accordingly, as shown in FIG. 4, the HMI 400 may display a field corresponding to the first seat 144A with cross-hatching to indicate that the first seat 144A is out-of-service. Notably, the HMI 400 may display fields corresponding to the second seat 144B, the third seat 146A, and the fourth seat 146B without any marks to indicate that the second seat 144B, the third seat 146A, and the fourth seat 146B are in-service.

In an aspect, the HMI 400 may be configured to receive input from a ride operator and/or technician. Accordingly, if the ride operator and/or technician determines that a seat of a ride vehicle is out-of-service (e.g., upon inspection of the seat), the ride operator and/or technician may update the HMI 400 with the determined status of the seat. In an aspect, the screen 402 of the HMI 400 may be a touchscreen responsive to the ride operator's and/or technician's touch. Therefore, the rider operator/technician may press a field on the screen 402 corresponding to the out-of-service seat (e.g., first seat 124A of the first ride vehicle 104, fourth seat 126B of the first ride vehicle 104, and/or first seat 144A of the third ride vehicle 118) to change a color of the field and/or add a distinguishing mark to the field and/or change a distinguishing mark of the field and/or remove a distinguishing mark from the field to indicate that the corresponding seat is out-of-service. Later, if the seat of the ride vehicle is back in service (e.g., determined to be back in-service), the ride operator and/or technician may press the field on the screen 402 corresponding to the out-of-service seat to change the color of the field (e.g., back to its original state (e.g., original color)) and/or add a distinguishing mark to the field and/or change a distinguishing mark of the field and/or remove a distinguishing mark from the field to indicate that the corresponding seat is in-service. In an aspect, the screen 402 may not be a touchscreen responsive to the ride operator's and/or technician's touch. As such, the HMI 400 may be configured to receive inputs from the ride operator and/or technician via other types of input devices, such as a keypad, a keyboard, a mouse, or any combination thereof.

Figure 5:
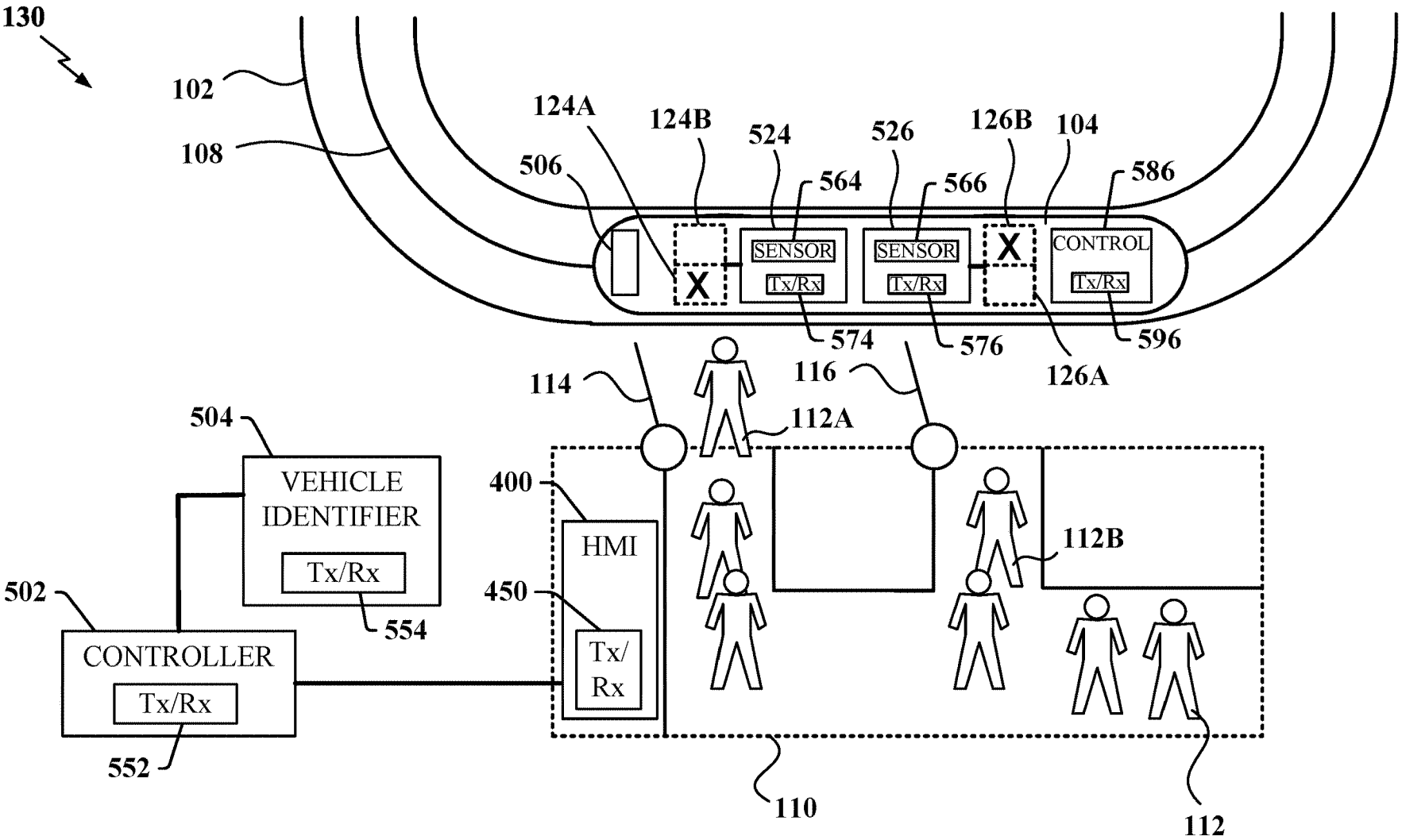
FIG. 5 is an expanded view of a region of the example ride system depicted in FIG. 1 implementing a controller configured to control a ride vehicle restraint of the ride system in accordance with various aspects of the disclosure.

FIG. 5 is an expanded view of a region 130 of the example ride system 100 depicted in FIG. 1 implementing a controller configured to control a ride vehicle restraint in the ride system in accordance with various aspects of the disclosure. In an aspect, the controller may be configured to monitor and/or determine when one or more seats of a ride vehicle is out-of-service and instruct prevention of a restraint system of the one or more out-of-service seats from being opened. The ride system may include a controller 502, a ride vehicle identifier 504, one or more unique identification (ID) attributes 506 mounted to a ride vehicle, the HMI 400 described above with respect to FIG. 4, and one or more gates (e.g., first gate 114 and second gate 116) configured to control the flow of passengers 112 boarding a ride vehicle (e.g., first ride vehicle 104). The controller 502 may be coupled to ride vehicle seats, seat restraint systems, the ride vehicle identifier 504, the HMI 400, and/or the one or more gates via a wired or wireless connection.

In an aspect, the controller 502 may be configured to determine a status of each seat (e.g., whether the seat is in-service or out-of-service) of each ride vehicle in the ride system based on inputs received from the ride operator and/or technician via the HMI 400. The HMI 400 may include or be coupled to one or more transmitters, receivers, and/or transceivers 450 configured to communicate with one or more transmitters, receivers, and/or transceivers 552 of the controller 502. Accordingly, when the HMI 400 receives data indicating whether a ride vehicle seat of a particular ride vehicle is in-service or out-of-service from the ride operator and/or technician, the HMI 400 may directly transfer the data to the controller 502. Upon being signaled that a ride vehicle seat of a particular ride vehicle is out-of-service, the controller 502 may instruct a restraint system corresponding to the out-of-service seat to lock or remain locked (e.g., in a closed position). The controller 502 may further instruct any restraint systems corresponding to in-service seats to unlock and/or open.

Additionally or alternatively, the controller 502 may be configured to communicate (e.g., via a wired or wireless connection) with one or more sensors systems (e.g., first sensor system 524 and second sensor system 526), wherein the sensor systems may comprise one or more sensors (e.g., first sensor 564 and second sensor 566) and communication circuitry (e.g., wired communication circuitry, wireless communication circuitry (e.g., transmitters, receivers, and/or transceivers 574, 576)). A sensor (e.g., light sensor, sound sensor, vibration sensor, displacement sensor, temperature sensor, strain sensor, force sensor, pressure sensor, camera) of the one or more sensor systems may be configured to autonomously detect data indicative of an out-of-service triggering event (e.g., inputs indicating it is time for maintenance or inspection (e.g., threshold number of cycles completed), threshold temperature reached, threshold displacement (e.g., of a component) reached, threshold strain (e.g., of a component) reached, threshold force and/or pressure reached, threshold vibration and/or sound level reached, detected malfunction, detected potential malfunction, detected damage, detected potential damage) of a ride vehicle seat, seat row of a particular ride vehicle, and/or entire ride vehicle. As such, the controller 502 may also detect whether a seat of a particular ride vehicle is in-service or out-of-service based on a direct signal from the one or more sensor systems. For example, the one or more sensor systems may be mounted on a ride vehicle seat, a surface of the ride vehicle, and/or anywhere along the path 102 within a detecting range of the ride vehicle seat. The one or more sensor systems may include and/or be coupled to one or more transmitters, receivers, and/or transceivers configured to communicate with the one or more transmitters, receivers, and/or transceivers 552 of the controller 502. Accordingly, when the one or more sensors detects an out-of-service triggering event of a ride vehicle seat, the one or more sensors may directly communicate the out-of-service-triggering event to the controller 502. Upon being signaled of the out-of-service triggering event of the ride vehicle seat, the controller 502 may determine that the ride vehicle seat is out-of-service and instruct a restraint system corresponding to the out-of-service seat to lock or remain locked (e.g., in a closed position). The controller 502 may instruct any restraint systems corresponding to in-service seats to unlock and/or open. Upon receiving data indicative of an out-of-service triggering event of a ride vehicle row, the controller 502 may determine that the ride vehicle row is out-of-service. The controller 502 may then instruct each restraint system corresponding to each seat of the out-of-service seat row to lock or remain locked (e.g., in a closed position). Upon receiving data indicative of an out-of-service triggering event of a ride vehicle, the controller 502 may determine that all seats of the ride vehicle are out-of-service. The controller 502 may then instruct all seats of the ride vehicle to lock or remain locked (e.g., in a closed position).

In an aspect, all ride vehicles in the ride system may be uniquely identified by the controller 502 via the ride vehicle identifier 504. For example, each ride vehicle may be assigned a unique identification attribute 506, such as a unique identification (ID) tag (e.g., RFID tag, bar code, QR code). Accordingly, the ride vehicle identifier 504 may be configured as an ID tag reader (e.g., RFID reader, bar code reader, QR code reader) and the controller 502 may identify a ride vehicle based on the unique ID tag read by the ride vehicle identifier 504 and communicated to the controller 502.

In another example, the unique identification attribute 506 of a ride vehicle may be one or more surfaces of a ride vehicle displaying a unique image, unique color, and/or unique retroreflective pattern (e.g., reflected infrared light). Accordingly, the ride vehicle identifier 504 may comprise one or more cameras configured to capture and/or recognize the unique image, unique color, and/or unique retroreflective pattern and the controller 502 may identify the ride vehicle based on the unique image, unique color, and/or unique or retroreflective pattern captured and/or recognized by the ride vehicle identifier 504 and communicated to the controller 502.

In a further example, a ride vehicle may emit unique light pulses (e.g., infrared light pulses, specifically and/or uniquely timed light pulses) and/or specific colored light. Accordingly, the ride vehicle identifier 504 may comprise one or more light sensors configured to read and/or recognize the unique light pulses and/or specific colored light, and/or the ride vehicle identifier 504 may comprise one or more cameras configured to read and/or recognize the unique light pulses and/or specific colored light. The controller 502 may identify the ride vehicle based on the unique light pulses and/or specific colored light read and/or recognized by the ride vehicle identifier 504 and communicated to the controller 502. The one or more light sensors may comprise one or more color sensors.

In another example, the controller 502 may identify a ride vehicle using a counting mechanism. Here, the ride vehicle identifier 504 may be configured as a ride vehicle counter configured to count the number of ride vehicles passing through an observation range of the ride vehicle identifier 504. Based on a known number of ride vehicles operating in the ride system 100, the controller 502 may identify the ride vehicle according to the number of ride vehicles counted by the ride vehicle identifier 504. For example, if the number of known ride vehicles operating in the system 100 is 3 and if a ride vehicle currently counted by the ride vehicle identifier 504 is determined to have at least one out-of-service seat, then the controller 502 may identify that every third ride vehicle counted by the ride vehicle identifier 504 after the currently counted ride vehicle is the ride vehicle having at least one out-of-service seat.

In an aspect, the ride vehicle identifier 504 may include and/or be coupled to one or more transmitters, receivers, and/or transceivers 554 configured to communicate with the one or more transmitters, receivers, and/or transceivers 552 of the controller 502. Accordingly, when the ride vehicle identifier 504 captures and/or identifies a unique identifying attribute 506 (e.g., unique ID tag (e.g., RFID tag, bar code, QR code), image, color, retroreflective pattern, light pulse pattern, specific colored light, and/or ride vehicle count) of a ride vehicle as described above, the ride vehicle identifier 504 may directly signal the identifying attribute to the controller 502. Upon identifying a particular ride vehicle based on the identifying attribute, the controller 502 may determine whether any seats of the identified ride vehicle are out-of-service. If so, the controller 502 may instruct a restraint system corresponding to an out-of-service seat to lock or remain locked (in a closed position). Upon identifying a particular ride vehicle based on the identifying attribute 506, the controller 502 may determine whether any seats of the identified ride vehicle are in-service. If so, the controller 502 may instruct any restraint systems corresponding to in-service seats to unlock and/or open.

In an embodiment, the ride system may further include an on-board controller 586 located on board a ride vehicle. The on-board controller 586 may include or be coupled to communication circuitry, such as one or more transmitters, receivers, and/or transceivers 596 and may be configured to communicate with the one or more transmitters, receivers, and/or transceivers 574, 576 of the one or more sensor systems 524, 526. Accordingly, the on-board controller 586 may track which seats are in-service and/or out-of-service by communicating with a sensor system (e.g., first sensor system 524 or second sensor system 526) corresponding to a particular seat. The communication circuitry (e.g., the one or more transmitters, receivers, and/or transceivers 596) of the on-board controller 586 may be configured to communicate with the one or more transmitters, receivers, and/or transceivers 552 of the controller 502. Accordingly, after determining which seat or seats are in-service and/or out-of-service, the on-board controller 586 may communicate the determination to the controller 502.

In an embodiment, each seat of a ride vehicle (e.g., first seat 124A, second seat 124B, third seat 126A, and fourth seat 126B) may include a corresponding seat controller that tracks if the corresponding seat is in-service and/or out-of-service. The seat controller may include or be coupled to communication circuitry, such as one or more transmitters, receivers, and/or transceivers and may be configured to communicate with the one or more transmitters, receivers, and/or transceivers 552 of the controller 502. Accordingly, after determining whether a corresponding seat is in-service and/or out-of-service, the seat controller may communicate the determination directly to the controller 502. In an aspect, the communication circuitry (e.g., the one or more transmitters, receivers, and/or transceivers) of the seat controller may be configured to communicate with the one or more transmitters, receivers, and/or transceivers 596 of the on-board controller 586. Accordingly, after determining whether a corresponding seat is in-service and/or out-of-service, the seat controller may first communicate the determination to the on-board controller 586, which may then communicate the determination to the controller 502.

In an embodiment, the above-described seat sensor systems (e.g., first sensor system 524 and second sensor system 526) may communicate (e.g., via the one or more transmitters, receivers, and/or transceivers 574, 576) data indicative of an out-of-service triggering event of a ride vehicle seat, seat row, or entire ride vehicle, to the one or more unique identification attributes 506 (e.g., unique ID tag), which may then pass the data to the ride vehicle identifier 504. For example, the one or more unique ID attributes 506 may receive the data from the sensor systems if the one or more unique ID attributes 506 is an RFID card that is rewritten and/or updated based on seat status. In another example, the one or more unique ID attributes 506 may be one or more light pulses capable of being augmented. Accordingly, the one or more unique ID attributes 506 may include or be coupled to a light pulse system that augments the one or more light pulses based on the data received from the sensor systems, e.g., the one or more light pulses may be augmented to account for all possible seat, seat row, and/or ride vehicle statuses in addition to vehicle identification. In an aspect, the light pulse system may include a controller to receive the data and augment the one or more light pulses accordingly. In an aspect, additionally and/or alternatively to the seat sensor systems communicating the data indicative of the out-of-service triggering event of the ride vehicle seat, row, and/or the entire ride vehicle to the controller 502, the data may be communicated by the on-board controller 586 and/or the seat controller described above. In an aspect, the seat sensor systems may directly communicate (e.g., via the one or more transmitters, receivers, and/or transceivers 574, 576) the data indicative of the out-of-service triggering event of the ride vehicle seat, row, and/or the entire ride vehicle, to the one or more transmitters, receivers, and/or transceivers 554 of the ride vehicle identifier 504.

In an embodiment, the above-described seat sensor systems (e.g., first sensor system 524 and second sensor system 526) may communicate (e.g., via the one or more transmitters, receivers, and/or transceivers 574, 576) data indicative of an out-of-service triggering event of a ride vehicle seat, row, or entire ride vehicle, to the one or more transmitters, receivers, and/or transceivers 450 of the HMI 400, which may then pass the data to the controller 502. For example, the HMI 400 may automatically update and display out-of-service seats based on the data received from the sensor systems. In an aspect, the HMI 400 may include a controller to process the data received from the sensor systems. For example, if the HMI 400 may receive data indicating that a particular seat is out-of-service, then the controller of the HMI 400 may process the seat data and/or instruct a restraint system corresponding to the particular out-of-service seat to lock or remain locked (e.g., in a closed position). In an aspect, additionally and/or alternatively to the seat sensor systems communicating the data indicative of the out-of-service triggering event of the ride vehicle seat, row, or the entire ride vehicle to the HMI 400, the data may be communicated by the on-board controller 586 described above and/or a seat controller. In an embodiment, an on-board controller 586 may receive data indicating that a particular seat is out-of-service and instruct a restraint system corresponding to the particular out-of-service seat to lock or remain locked (e.g., in a closed position). In an embodiment, seat controller may receive data indicating that a corresponding seat is out-of-service and instruct a restraint system corresponding to the corresponding out-of-service seat to lock or remain locked (e.g., in a closed position).

An example identifying technique using the unique ID attribute 506 comprising a unique ID tag will now be described in more detail. A unique ID tag may be mounted to a surface of a ride vehicle. For example, the first ride vehicle 104, the second ride vehicle 106, and the third ride vehicle 118 may each be assigned a unique ID tag mounted to a surface thereof. Accordingly, the controller 502 may identify a particular ride vehicle based on the unique ID tag using the ride vehicle identifier 504. In an aspect, the ride vehicle identifier 504 may be located on or near the passenger loading platform 110. As a ride vehicle arrives at the platform 110, the ride vehicle identifier 504 may read the unique ID tag mounted to the ride vehicle and provide the data relayed from the unique ID tag to the controller 502. In an aspect, the ride vehicle identifier 504 may transmit (e.g., via a transmitter or transceiver 554) a signal corresponding to the data relayed from the unique ID tag that will be received (e.g., via a receiver or transceiver 552) by the controller 502. Based on the received signal corresponding to the data relayed from the unique ID tag, the controller 502 may determine which particular ride vehicle is stopped at the platform 110. The controller 502 may also determine whether any seats of the determined ride vehicle are out-of-service. For example, the controller 502 may determine the existence of an out-of-service and/or in-service seat based on the data input to the HMI 400 by the ride operator and/or technician and/or a direct communication from one or more sensors autonomously detecting an out-of-service triggering event of a ride vehicle seat. Accordingly, when the controller 502 determines that one or more seats of the ride vehicle stopped at the platform 110 is out-of-service, the controller 502 may instruct one or more restraint systems respectively corresponding to the one or more out-of-service seats to lock or remain locked (e.g., in a closed position) while instructing any restraint systems corresponding to in-service seats to unlock and/or open. Consequently, this will prevent a passenger from being able to manually open a restraint system of an out-of-service seat.

As an example, the first ride vehicle 104 may be assigned a unique ID attribute 506 comprising a unique ID tag (e.g., RFID tag, bar code, QR code) mounted to a surface of the first ride vehicle 104. Moreover, the first seat 124A and the fourth seat 126B may be out-of-service and previously indicated as such in the HMI 400 by a ride operator and/or technician. When the first ride vehicle 104 arrives at the passenger loading platform 110, the ride vehicle identifier 504 may read the unique ID attribute 506 (e.g., unique ID tag) as the unique ID attribute 506 (e.g., unique ID tag) enters a sensing range of the ride vehicle identifier 504 and transmits the data from the unique ID attribute 506 (e.g., unique ID tag) to the controller 502. Upon receiving the data transmitted from the unique ID attribute 506 (e.g., unique ID tag), the controller 502 may determine that the first ride vehicle 104 is stopped at the platform 110 and may further determine whether any seats of the first ride vehicle 104 are out-of-service by accessing the data input to the HMI 400. When the controller 502 is signaled that the first seat 124A and the fourth seat 126B are out-of-service (as indicated in the HMI 400), the controller 502 may instruct a restraint system of the first seat 124A and a restraint system of the fourth seat 126B to lock or remain locked (e.g., in a closed position) while instructing a restraint system of the second seat 124B and a restraint system of the third seat 126A to unlock and/or open. This prevents a passenger walking through the first gate 114 (e.g., first passenger 112A) or the second gate 116 (e.g., second passenger 112B) from being able to manually open a restraint system of an out-of-service seat (e.g., first seat 124A and fourth seat 126B), and allows the passenger to sit in an in-service seat (e.g., second seat 124B or third seat 126A).

In an aspect, the controller 502 may instruct a restraint system of an out-of-service seat (e.g., first seat 124A or fourth seat 126B) to lock or remain locked by refraining to send a signal to unlock or open the restraint system (e.g., refraining to send an "unlock" or "open" signal). Additionally or alternatively, the controller 502 may block a signal for unlocking or opening the restraint system upon determining that a seat associated with the restraint system is out-of-service. Additionally or alternatively, the controller 502 may control (e.g., instruct) a restraint system corresponding to an out-of-service seat (e.g., first seat 124A or fourth seat 126B) to lock or remain locked (e.g., in a closed position) by sending a signal to lock the restraint system (e.g., sending a "lock" or "close" signal).

Figure 6:
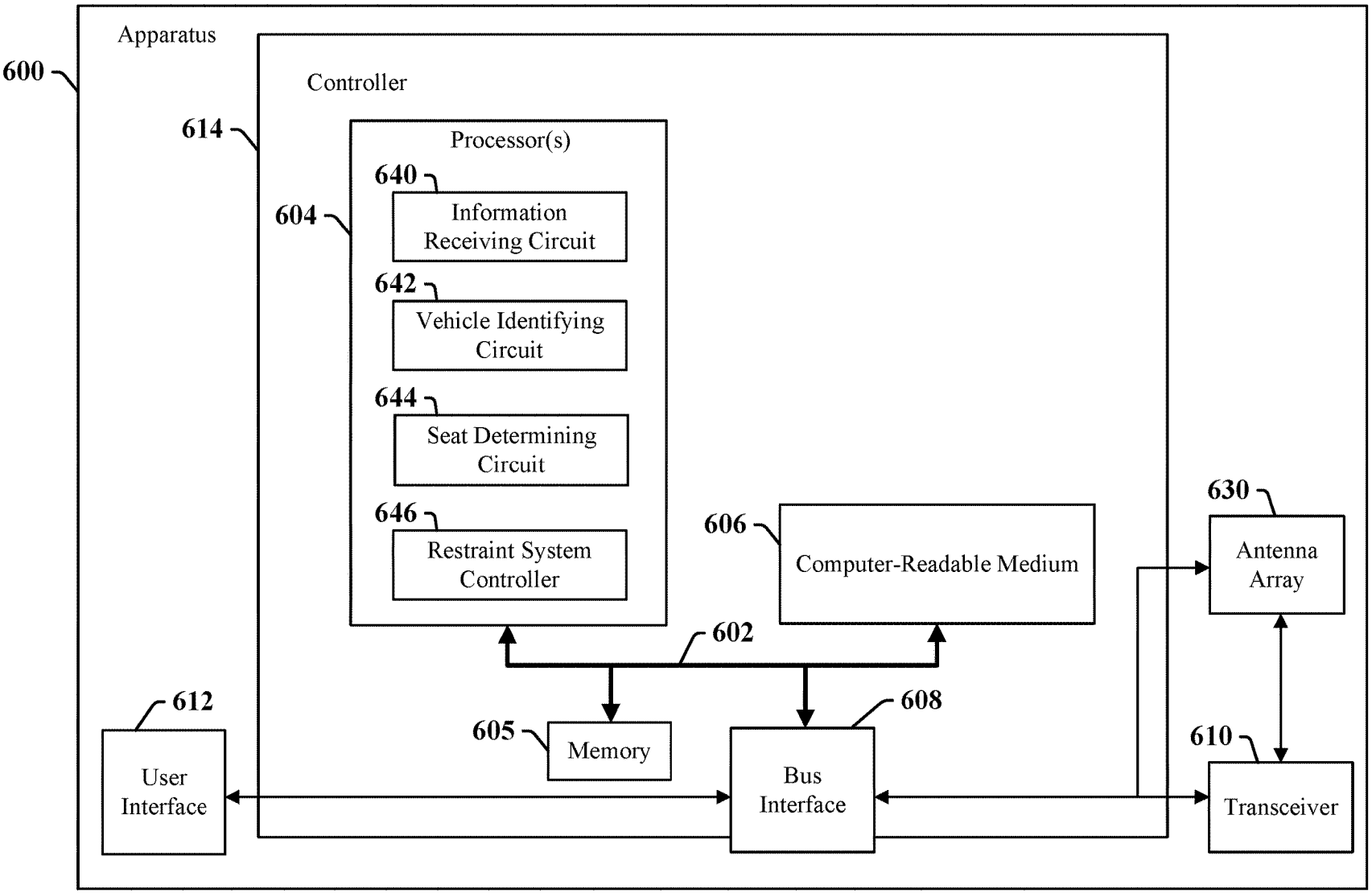
FIG. 6 is a block diagram illustrating an example of a hardware implementation for an exemplary apparatus employing a controller configured to control a ride vehicle restraint in a ride system in accordance with various aspects of the disclosure.

FIG. 6 is a block diagram illustrating an example of a hardware implementation for an exemplary apparatus 600 employing a controller 614 configured to control a ride vehicle restraint in a ride system. For example, the apparatus 600 may be a computer, workstation, laptop, tablet, mobile phone, or any other type of electronic device capable of communicating with and/or controlling other electronic devices. Moreover, the controller 614 may be the controller 502 shown in FIG. 5. The controller 614 may comprise one or more processors 604. Examples of processors 604 include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. In various examples, the apparatus 600 may be configured to perform any one or more of the functions described herein. That is, the processor 604, as utilized in an apparatus 600, may be used to implement any one or more of the processes and procedures described and illustrated in FIG. 7.

In this example, the controller 614 may be implemented with a bus architecture, represented generally by a bus 602. The bus 602 may include any number of interconnecting buses and bridges depending on the specific application of the controller 614 and the overall design constraints. The bus 602 may communicatively couple together various circuits including one or more processors (represented generally by the processor 604), a memory 605, and/or computer-readable media (represented generally by the computer-readable medium 606). The bus 602 may also link various other circuits such as timing sources, peripherals, voltage regulators, and power management circuits, which are well known in the art, and therefore, will not be described any further. A bus interface 608 provides an interface between the bus 602 and a transceiver 610. The transceiver 610 may provide a communication interface or means for communicating with various other apparatus over a transmission medium (e.g., via a wired connection and/or a wireless connection using an antenna array 630). For example, the transceiver 610 may provide a communication interface between the controller 614 and the ride vehicle identifier 504, the HMI 400, ride vehicle seats, seat restraint systems, sensors configured to autonomously detect an out-of-service triggering event of a ride vehicle seat, and/or any components of a ride vehicle system capable of communication. Depending upon the nature of the apparatus, a user interface 612 (e.g., keypad, display, speaker, microphone, joystick) may also be provided. Of course, such a user interface 612 is optional, and may be omitted in some examples.

In some aspects of the disclosure, the processor 604 may include data receiving circuitry 640 configured for various functions, including, for example, receiving data corresponding to an identity of one or more ride vehicles prior to the one or more ride vehicles stopping at a passenger loading platform, wherein the data may indicate which seat or seats of one or more seats included in the one or more ride vehicles are in-service or out-of-service. For example, the data receiving circuitry 640 may be configured to implement one or more of the functions described below in relation to FIG. 7, including, e.g., block 702. The processor 604 may also include vehicle identifying circuitry 642 configured for various functions, including, for example, identifying the one or more ride vehicles stopped at the passenger loading platform, the one or more ride vehicles including the one or more seats. For example, the vehicle identifying circuitry 642 may be configured to implement one or more of the functions described below in relation to FIG. 7, including, e.g., block 704. The processor 604 may also include seat determining circuitry 644 configured for various functions, including, for example, determining which seat or seats of the one or more seats are in-service and determining which seat or seats of the one or more seats are out-of-service based at least in part on the data corresponding to the identity of the one or more ride vehicles. For example, the seat determining circuitry 644 may be configured to implement one or more of the functions described below in relation to FIG. 7, including, e.g., block 706. The processor 604 may also include a restraint system controller 646 configured for various functions, including, for example, instructing to lock one or more restraint systems corresponding to at least one seat of the one or more seats determined to be out-of-service and instructing to unlock one or more other restraint systems corresponding to at least one other seat of the one or more seats determined to be in-service. For example, the restraint system controller 646 may be configured to implement one or more of the functions described below in relation to FIG. 7, including blocks 708 and 710.

The processor 604 is responsible for managing the bus 602 and general processing, including the execution of software stored on the computer-readable medium 606. The software, when executed by the processor 604, causes the controller 614 to perform the various functions described below for any particular apparatus. The computer-readable medium 606 and/or the memory 605 may also be used for storing data that is manipulated by the processor 604 when executing software.

One or more processors 604 in the controller may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The software may reside on a computer-readable medium 606 and/or the memory 605. The computer-readable medium 606 and/or the memory 605 may be a non-transitory computer-readable medium. A non-transitory computer-readable medium includes, by way of example, a magnetic storage device (e.g., hard disk, floppy disk, magnetic strip), an optical disk (e.g., a compact disc (CD) or a digital versatile disc (DVD)), a smart card, a flash memory device (e.g., a card, a stick, or a key drive), a random access memory (RAM), a read only memory (ROM), a programmable ROM (PROM), an erasable PROM (EPROM), an electrically erasable PROM (EEPROM), a register, a removable disk, and any other suitable medium for storing software and/or instructions that may be accessed and read by a computer. The computer-readable medium 606 and/or the memory 605 may reside in the controller 614, external to the controller 614, or distributed across multiple entities including the controller 614. The computer-readable medium 606 and/or the memory 605 may be embodied in a computer program product. By way of example, a computer program product may include a computer-readable medium in packaging materials. Those skilled in the art will recognize how best to implement the described functionality presented throughout this disclosure depending on the particular application and the overall design constraints imposed on the overall system.

Figure 7:
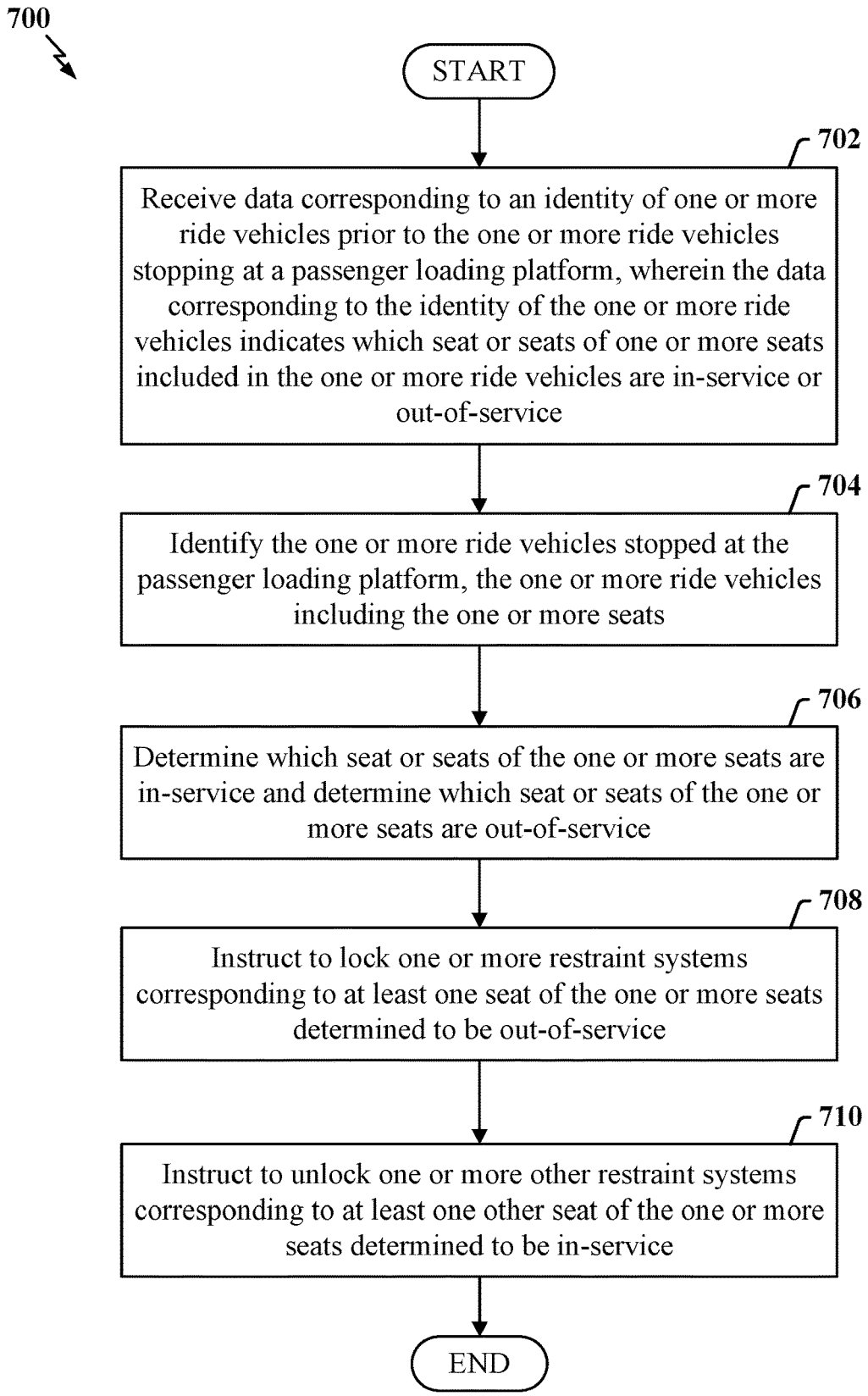
FIG. 7 is a flow chart illustrating an exemplary process for controlling a ride vehicle restraint in a ride system in accordance with aspects of the present disclosure.

FIG. 7 is a flow chart illustrating an exemplary process 700 for controlling a ride vehicle restraint in a ride system in accordance with aspects of the present disclosure. As described below, some or all illustrated features may be omitted in a particular implementation within the scope of the present disclosure, and some illustrated features may not be required for implementation of all aspects. In some examples, the process 700 may be carried out by the controller 614 of the apparatus 600 illustrated in FIG. 6, which may be a computer, workstation, laptop, tablet, mobile phone, or any other type of electronic device capable of communicating with and/or controlling (e.g., instructing) other electronic devices. In some examples, the process 700 may be carried out by any suitable apparatus or means for carrying out the functions or algorithm described below.

At block 702, the controller may receive data corresponding to an identity of one or more ride vehicles (e.g., first ride vehicle 104, second ride vehicle 106, and/or third ride vehicle 118) prior to the one or more ride vehicles stopping at a passenger loading platform (e.g., passenger loading platform 110), wherein the data indicates which seat or seats of one or more seats included in the one or more ride vehicles are in-service or which seat or seats of the one or more seats are out-of-service. In an aspect, the data is received via an interface device (e.g., HMI 400) configured to receive the data from a ride system operator or technician.

At block 704, the controller may identify the one or more ride vehicles stopped at the passenger loading platform. The one or more ride vehicles may include the one or more seats. In an aspect, the controller may identify data corresponding to (e.g., indicative of) the identity of the one or more ride vehicles at least in part via a signal from a ride vehicle identifier (e.g., radio frequency identification (RFID) reader, bar code reader, QR code reader, camera, light sensor, and/or ride vehicle counter) configured to identify a unique identifying attribute (e.g., unique ID tag (e.g., RFID tag, bar code, QR code), image, retroreflective pattern, color, light pulse pattern, and/or ride vehicle count) of the one or more ride vehicles.

At block 706, the controller may determine which seat or seats of the one or more seats are in-service and determine which seat or seats of the one or more seats are out-of-service based at least in part on the data corresponding to (e.g., indicative of) the identity of the one or more ride vehicles. In an aspect, the controller may determine which seat or seats are in-service or out-of-service by reading the received data corresponding at least in part to the data corresponding to (e.g., indicative of) the identity of the one or more ride vehicles.

At block 708, the controller may instruct to lock or remain locked (e.g., in a closed position) one or more restraint systems corresponding to at least one seat of the one or more seats determined to be out-of-service (e.g., first seat 124A and/or fourth seat 126B). In an aspect, the one or more restraint systems may be instructed to lock to prevent passengers from manually opening a restraint system of an out-of-service seat (e.g., unstrapping the restraint system and/or removing a barrier placed on the seat or restraint system) of the one or more ride vehicles and subsequently sitting in the out-of-service seat. In an aspect, the controller may instruct to lock the one or more restraint systems by refraining from sending a signal to unlock or open the one or more restraint systems (e.g., refraining from sending an "unlock signal" or an "open signal") or blocking a signal for unlocking or opening the one or more restraint systems from being sent (e.g., blocking an "unlock signal" or an "open signal" from being sent). In an aspect, the controller may instruct to lock the one or more restraint systems by sending a signal to lock or close the one or more restraint systems (e.g., sending a "lock signal" or a "close signal").

At block 710, the controller may instruct to unlock or open one or more other restraint systems corresponding to at least one other seat of the one or more seats determined to be in-service (e.g., second seat 124B or third seat 126A). In an aspect, the one or more other restraint systems are instructed to unlock or open to allow passengers to sit in an in-service seat of the one or more ride vehicles.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another-even if they do not directly physically touch each other. For instance, a first object may be coupled to a second object even though the first object is never directly physically in contact with the second object. Moreover, the term "comprising," "including," "containing," or "having" is inclusive or open-ended and does not exclude additional, unrecited elements or method steps.

One or more of the components, steps, features and/or functions illustrated in FIGS. 1-7 may be rearranged and/or combined into a single component, step, feature or function or embodied in several components, steps, or functions. Additional elements, components, steps, and/or functions may also be added without departing from novel features disclosed herein. The apparatus, devices, and/or components illustrated in FIGS. 1-7 may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. A ride system comprising:

one or more ride vehicles including one or more seats;

a passenger loading platform;

a ride vehicle identifier configured to identify the one or more ride vehicles stopped at the passenger loading platform; and a controller communicatively coupled to the one or more seats and the ride vehicle identifier, the controller configured to:

determine which seat or seats of the one or more seats are in-service;

determine which seat or seats of the one or more seats are out-of-service;

instruct to lock one or more restraint systems corresponding to at least one seat of the one or more seats determined to be out-of-service; and instruct to unlock one or more other restraint systems corresponding to at least one other seat of the one or more seats determined to be in-service.

2. The ride system of claim 1, wherein the controller is further configured to:

receive data corresponding to the identity of the one or more ride vehicles prior to the one or more ride vehicles stopping at the passenger loading platform, wherein the data corresponding to the identity of the one or more ride vehicles indicates which seat or seats of the one or more seats are in-service or which seat or seats of the one or more seats are out-of-service.

3. The ride system of claim 2, further comprising:

an interface device communicatively coupled to the controller, wherein the controller is configured to receive the data corresponding to the identity of the one or more ride vehicles from the interface device, and wherein the interface device is configured to receive the data from a ride system operator or technician.

4. The ride system of claim 2, wherein the control system configured to determine which seat or seats of the one or more seats are in-service or out-of-service is configured to at least:

read the received data corresponding to the identity of the one or more ride vehicles;

receive data indicative of an out-of-service triggering event from an on-board controller of the one or more ride vehicles; or receive the data indicative of the out-of-service triggering event from a seat sensor system of the one or more ride vehicles.

5. The ride system of claim 1, wherein the ride vehicle identifier comprises a radio frequency identification (RFID) reader configured to identify the one or more ride vehicles, wherein the RFID reader is configured to:

read an RFID tag mounted to the one or more ride vehicles.

6. The ride system of claim 1, wherein the controller is configured to instruct to lock one or more restraint systems corresponding to at least one seat of the one or more seats determined to be out-of-service at least in part by:

refraining from sending a signal to unlock the one or more restraint systems corresponding to at least one seat of the one or more seats determined to be out-of-service;

blocking a signal for unlocking the one or more restraint systems corresponding to at least one seat of the one or more seats determined to be out-of-service from being sent; or sending a signal to lock the one or more restraint systems corresponding to at least one seat of the one or more seats determined to be out-of-service.

7. The ride system of claim 1, wherein the ride vehicle identifier comprises at least a radio frequency identification (RFID) reader, a barcode reader, a QR code reader, a camera, a light sensor, a color sensor, or a ride vehicle counter.

8. A method of controlling a ride vehicle restraint in a ride system, the method comprising:

identifying one or more ride vehicles stopped at a passenger loading platform, the one or more ride vehicles including one or more seats;

determining which seat or seats of the one or more seats are in-service;

determining which seat or seats of the one or more seats are out-of-service;

instructing to lock one or more restraint systems corresponding to at least one seat of the one or more seats determined to be out-of-service; and instructing to unlock one or more other restraint systems corresponding to at least one other seat of the one or more seats determined to be in-service.

9. The method of claim 8, further comprising:

receiving data corresponding to the identity of the one or more ride vehicles prior to the one or more ride vehicles stopping at the passenger loading platform, wherein the data corresponding to the identity of the one or more ride vehicles indicates which seat or seats of the one or more seats are in-service or which seat or seats of the one or more seats are out-of-service.

10. The method of claim 9, wherein the data corresponding to the identity of the one or more ride vehicles is received via an interface device configured to receive the data from a ride system operator or technician.

11. The method of claim 9, wherein the determining which seat or seats of the one or more seats are in-service or out-of-service comprises at least:

reading the received data corresponding to the identity of the one or more ride vehicles;

receiving data indicative of an out-of-service triggering event from an on-board controller of the one or more ride vehicles; or receiving the data indicative of the out-of-service triggering event from a seat sensor system of the one or more ride vehicles.

12. The method of claim 8, wherein the identifying the one or more ride vehicles comprises:

identifying a unique identifying attribute of the one or more ride vehicles.

13. The method of claim 8, wherein the instructing to lock the one or more restraint systems comprises at least:

refraining from sending a signal to unlock the one or more restraint systems corresponding to at least one seat of the one or more seats determined to be out-of-service;

blocking a signal for unlocking the one or more restraint systems corresponding to at least one seat of the one or more seats determined to be out-of-service from being sent; or sending a signal to lock the one or more restraint systems corresponding to at least one seat of the one or more seats determined to be out-of-service.

14. The method of claim 8, wherein the identifying the one or more ride vehicles comprises identifying via at least a radio frequency identification (RFID) reader, a barcode reader, a QR code reader, a light sensor, a color sensor, a camera, or a ride vehicle counter.

15. An apparatus for controlling a ride vehicle restraint in a ride system, the apparatus comprising:

at least one processor, wherein the at least one processor is configured to:

identify one or more ride vehicles stopped at a passenger loading platform, the one or more ride vehicles including one or more seats, determine which seat or seats of the one or more seats are in-service, determine which seat or seats of the one or more seats are out-of-service, instruct to lock one or more restraint systems corresponding to at least one seat of the one or more seats determined to be out-of-service, and instruct to unlock one or more other restraint systems corresponding to at least one other seat of the one or more seats determined to be in-service.

16. The apparatus of claim 15, wherein the at least one processor is further configured to:

receive data corresponding to the identity of the one or more ride vehicles prior to the one or more ride vehicles stopping at the passenger loading platform, wherein the data corresponding to the identity of the one or more ride vehicles indicates which seat or seats of the one or more seats are in-service or which seat or seats of the one or more seats are out-of-service.

17. The apparatus of claim 16, wherein the at least one processor is configured to receive the data corresponding to the identity of the one or more ride vehicles via an interface device configured to receive the data corresponding to the identity of the one or more ride vehicles from a ride system operator or technician.

18. The apparatus of claim 16, wherein the at least one processor configured to determine which seat or seats of the one or more seats are in-service or out-of-service is configured to at least:

read the received data corresponding to the identity of the one or more ride vehicles;

receive data indicative of an out-of-service triggering event from an on-board controller of the one or more ride vehicles; or receive the data indicative of the out-of-service triggering event from a seat sensor system of the one or more ride vehicles.

19. The apparatus of claim 15, wherein the at least one processor is configured to identify the one or more ride vehicles via a signal from a ride vehicle identifier configured to identify a unique identification attribute of the one or more ride vehicles.

20. The apparatus of claim 16, wherein the at least one processor configured to instruct to lock the one or more restraint systems is configured to at least:

refrain from sending a signal to unlock the one or more restraint systems corresponding to at least one seat of the one or more seats determined to be out-of-service;

block a signal for unlocking the one or more restraint systems corresponding to at least one seat of the one or more seats determined to be out-of-service from being sent; or send a signal to lock the one or more restraint systems corresponding to at least one seat of the one or more seats determined to be out-of-service.

* * * * *